United States Patent [19]

Lewis

[11] Patent Number: 4,807,404

[45] Date of Patent: Feb. 28, 1989

[54] SHARPENING DEVICE WITH REPLACEABLE SHARPENING ELEMENTS

[76] Inventor: Virgil P. Lewis, 9255-358 Magnolia Ave., Santee, Calif. 92071

[21] Appl. No.: 161,001

[22] Filed: Feb. 26, 1988

[51] Int. Cl.[4] ..... B24D 15/02

[52] U.S. Cl. ..... 51/362; 51/391; 51/211 R

[58] Field of Search ..... 51/288, 206, 207, 391, 51/358, 362, 211 R; 76/82, 82.2, 88; 83/174

[56] References Cited

U.S. PATENT DOCUMENTS

| | | | |
|---|---|---|---|
| 2,000,141 | 5/1935 | Liggieri | 51/211 R X |
| 4,222,204 | 9/1980 | Benner | 51/362 |
| 4,274,232 | 6/1981 | Wylde | 51/358 |
| 4,558,542 | 12/1985 | Marton | 51/358 |
| 4,667,447 | 5/1987 | Barton | 51/362 |

*Primary Examiner*—Donald R. Schran

*Attorney, Agent, or Firm*—Watson, Cole, Grindle & Watson

[57] ABSTRACT

A sharpening device for sharpening the edge of a cutting implement comprises a base element having a paramagnetic layer, an intermediate element which includes a flexible magnetic rubber layer and a flexible vinyl plastic layer, and a sharpening element which includes a grit paper having a rough upper surface and adhesive on its lower surface. The intermediate element is positioned on the base element such that its flexible magnetic rubber layer is in contact with (and becomes magnetically attached to) the paramagnetic layer of the base element and the sharpening element is positioned on the intermediate layer such that the adhesive on the lower surface of the grit paper thereof sticks to the vinyl plastic layer of the intermediate element. The sharpening device can be easily removed from the intermediate element and replaced when desired.

8 Claims, 1 Drawing Sheet

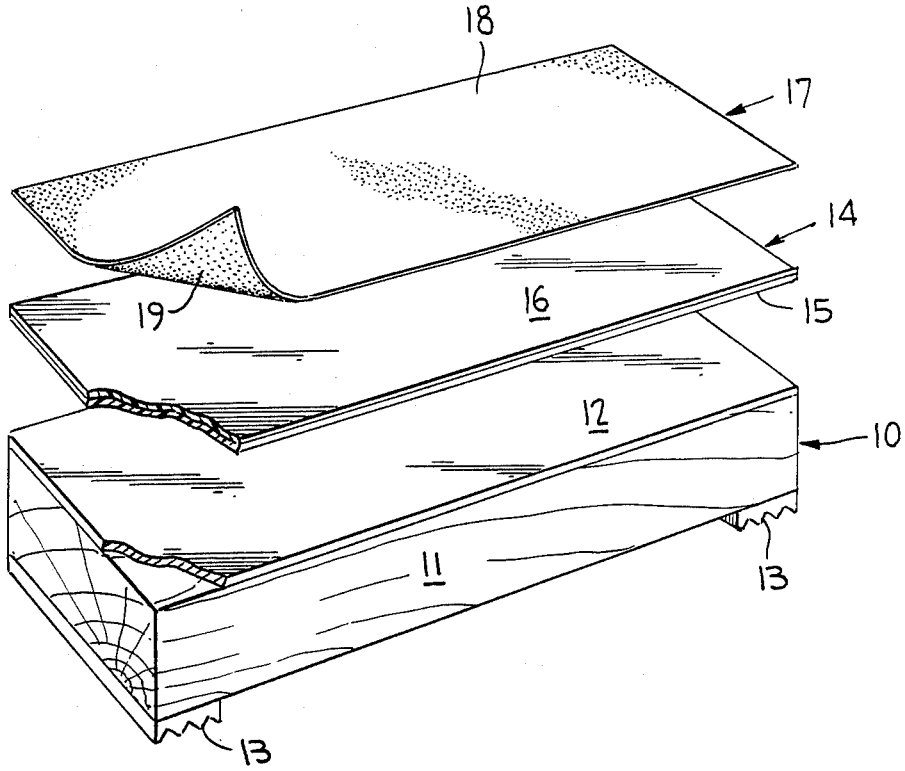
18
17
14
19
16
15
12
10
11
13
13

SHARPENING DEVICE WITH REPLACEABLE SHARPENING ELEMENTS

BACKGROUND OF THE INVENTION

1. Field of the Invention

The present invention relates to devices which can be used to sharpen cutting implements such as knives, scissors, grass clippers, pruning shears, etc.

2. The Prior Art

Devices for sharpening cutting implements such as knives and scissors are commonplace. Some are motorized and thus require a source of electrical energy for operation and some are not, such that their use requires a manual sliding contact between the device and the edge of the cutting implement which is to be sharpened. In devices of this latter category, and particularly those which utilize grit paper, the replacement of the grit paper is normally rather cumbersome and time consuming. In addition, these known devices do not always maintain the grit paper in a completely flat configuration, and as such the sharpening action may not be optimized.

SUMMARY OF THE INVENTION

The present invention provides a sharpening device of the manual type which utilizes replaceable sharpening elements and which not only enables the sharpening elements to be easily and quickly replaced when necessary but which also acts to always maintain the sharpening elements in a perfectly flat condition, thus maximizing the sharpening action thereof.

According to the invention the sharpening device includes a base element which is positionable on a suitable surface or which can fit in a user's hand and which includes a paramagnetic layer on its upper surface; an intermediate element which includes a magnetic layer which will magnetically adhere to the paramagnetic layer of the base element when brought into close proximity thereto; and a sharpening element which includes a grit paper having a rough upper surface and adhesive on its lower surface, this adhesive being removably attachable to the intermediate element. When the intermediate element is attached to the base element and the sharpening element is attached to the intermediate element, the inventive sharpening device is ready for use. The edge of the cutting implement to be sharpened can be moved back and forth over the rough upper surface of the sharpening paper of the sharpening element for sharpening, or else the sharpening device can be manually moved along the edge of the cutting implement. After the rough upper surface of the grit paper has become worn, or when it is otherwise desired to replace the sharpening element with another one whose grit paper has a different courseness in its rough upper surface, the sharpening element can be removed from the intermediate element and replaced with a different one.

The invention will be better understood by reference to the attached figure, taken in conjunction with the following discussion.

DESCRIPTION OF THE FIGURE

The attached figure shows an exploded perspective view of a preferred embodiment of a sharpening device according to the present invention.

DETAILED DESCRIPTION OF THE PREFERRED EMBODIMENT

As can be seen in the attached figure, the inventive sharpening device comprises a base element 10, an intermediate element 14 and a sharpening element 17. When readied for use, the sharpening element is positioned on the intermediate element and the intermediate element is in turn positioned on the base element so as to form a single unit. However, these elements are also manually separable as is indicated in the figure.

The base element 10 includes a block 11, which is preferably made of wood (e.g. oak), a flat paramagnetic layer 12 which is located on an upper surface of the block 11, and foot pads 13 which are attached to the lower surface of the block 11. The flat paramagnetic layer 12 is preferably composed of a zinc-clad sheet metal plate and the foot pads 13 are preferably composed of rubber. Both the flat paramagnetic layer 12 and the foot pads 13 can be fixedly attached to the block 11 by the use of a water-resistant contact cement. The entire base element 10 can be optionally coated with a clear finish for moisture protection.

The intermediate element 14 includes a lower magnetic layer 15 and an upper contact layer 16. The magnetic layer 15 will be strongly attracted to the paramagnetic layer 12 of the base element 10 when brought into close proximity thereto. The magnetic layer 15 is preferably composed of flexible magnetic rubber and the contact layer 16 is preferably composed of a thin, flexible sheet of vinyl plastic.

The sharpening element 17 is composed of a piece of grit paper having a rough upper surface 18 (e.g., provided by a layer of silicon carbide particles adhered thereto) and adhesive 19 on its lower surface. The adhesive 19, which may be in the form of a continuous layer or separated strips, will readily stick to the contact layer 16 of the intermediate element 14 when positioned thereagainst, yet will be manually detachable therefrom when desired.

The inventive sharpening device, after assembly as indicated in the figure, can be used in one of two ways. It can be positioned on a flat, preferably horizontal surface, the foot pads of the block element holding it stationarily in position, and the implement to be sharpened then moved back and forth over the rough upper surface of the grit paper of the sharpening element, or it can be held in the hand and moved along the implement to be sharpened, which in turn is (perhaps) held stationary. When the grit paper of the sharpening element eventually becomes worn and needs replacement, or else when it is desired to replace the sharpening element with another one having a grit paper of different coarseness, the sharpening element can be removed (peeled away) from the intermediate element and replaced. Replacement sharpening elements can include a peel-away layer of paper over the adhesive thereof to prevent unwanted sticking to objects during storage.

Various modifications can be made in the invention as just described and still fall within the scope of the appended claims.

I claim:

1. A sharpening device useful for sharpening cutting implements such as scissors, knives, pruning shears and grass clippers, said sharpening device comprising a base element which includes a block having an upper surface and a lower surface, a paramagnetic layer positioned on said upper surface, and foot pads fixedly attached to said lower surface, an intermediate element which includes a magnetic layer and a contact layer, said magnetic layer being magnetically attachable to said paramagnetic layer of said base element, and a sharpening element which includes a grit paper having a rough sharpening surface on one side thereof and an adhesive on an opposite side thereof, said adhesive being removably attachable to said contact layer of said intermediate element.

2. A sharpening device according to claim 1, wherein said block is made of wood.

3. A sharpening device according to claim 2, wherein said paramagnetic layer is a zinc-clad sheet metal plate.

4. A sharpening device according to claim 3, wherein said zinc-clad sheet metal plate is connected to the upper surface of said wooden block by a water-resistant contact cement.

5. A sharpening device according to claim 1, wherein said magnetic layer is made of flexible magnetic rubber.

6. A sharpening device according to claim 5, wherein said contact layer is made of flexible vinyl plastic.

7. A sharpening device according to claim 1, wherein said adhesive is in the form of a continuous layer on said grit paper.

8. A sharpening device according to claim 1, wherein said adhesive is in the form of separated strips on said grit paper.

* * * * *